US007013772B1

(12) United States Patent
Grace, Jr. et al.

(10) Patent No.: US 7,013,772 B1
(45) Date of Patent: Mar. 21, 2006

(54) METHOD AND APPARATUS FOR ARROW SHAFT TRUING

(75) Inventors: Louis Grace, Jr., North Street, MI (US); Nathaniel E. Grace, St. Clair, MI (US)

(73) Assignee: G5 Outdoors, LLC, Memphis, MI (US)

( * ) Notice: Subject to any disclaimer, the term of this patent is extended or adjusted under 35 U.S.C. 154(b) by 0 days.

(21) Appl. No.: 10/369,954

(22) Filed: Feb. 20, 2003

Related U.S. Application Data

(60) Provisional application No. 60/358,227, filed on Feb. 20, 2002.

(51) Int. Cl.
*B23B 1/00* (2006.01)

(52) U.S. Cl. ..... 82/1.11; 82/113

(58) Field of Classification Search ..... 82/1.11; 76/88, 82; 51/204; 315/138
See application file for complete search history.

(56) References Cited

U.S. PATENT DOCUMENTS 1,273,624 A * 7/1918 Krollius ..... 451/555
3,733,933 A * 5/1973 Longbrake ..... 76/88
4,228,703 A * 10/1980 Moss ..... 76/86
4,494,339 A * 1/1985 Pittaway ..... 451/540
4,869,027 A * 9/1989 McEvily ..... 451/555
4,966,208 A * 10/1990 Uang ..... 144/28.72
5,404,679 A * 4/1995 Friel et al. ..... 451/312
5,431,597 A * 7/1995 Anderson ..... 451/558
5,440,953 A * 8/1995 Gangelhoff et al. ..... 76/86
5,644,853 A * 7/1997 Dixon ..... 33/506
6,092,293 A * 7/2000 Donaldson ..... 30/457
6,237,656 B1 * 5/2001 Whitehead et al. ..... 144/28.3
6,473,976 B1 * 11/2002 Cocchiarella ..... 30/453

* cited by examiner

*Primary Examiner*—Willmon Fridie, Jr.
(74) *Attorney, Agent, or Firm*—Harness, Dickey & Pierce, P.L.C.

(57) ABSTRACT

A method and an apparatus for truing the interface between an arrow shaft or insert and the arrow tip is provided. A squaring tool having a frame with at least one V-shaped channel supports an arrow shaft in parallel with the frame longitudinal axis. A cutting tool is mounted on the frame. A cutting surface of the cutting tool is perpendicularly aligned to both the tool frame longitudinal axis and the V-shaped channels. Each channel supports the arrow wherein an arrow longitudinal axis aligns in parallel with the frame longitudinal axis. The arrow is placed in the tool having the interface adjacent to the cutting surface and the assembly is rotated within the channels as the arrow shaft is translated against the cutting surface. The interface is cut by the cutting surface to perpendicularly align the interface with the arrow longitudinal axis.

20 Claims, 3 Drawing Sheets

METHOD AND APPARATUS FOR ARROW SHAFT TRUING

CROSS-REFERENCE TO RELATED APPLICATIONS

This application claims the benefit of U.S. Provisional Application No. 60/358,227, filed on Feb. 20, 2002. The disclosure of the above application is incorporated herein by reference.

FIELD OF THE INVENTION

The present invention relates generally to a method and apparatus to true archery arrows and more specifically to a method and apparatus to true either an arrow insert or the arrow end for subsequent mounting of an arrow tip in line with the longitudinal axis of the arrow.

BACKGROUND OF THE INVENTION

A modern arrow comprises several components, some of which are designed to be assembled and/or replaced by an archer with the intent of facilitating interchangeability or repair in a simple home workshop environment or, if need arise, in the field. One group of such components are 1) the arrow tip, 2) the arrow shaft and 3) the threaded insert that connects the arrow tip to the arrow shaft.

To achieve true flight, the longitudinal axis of the tip should be collinear with the longitudinal axis of the arrow shaft. Any deviation of the tip away from the longitudinal axis of the shaft must be minimized to prevent inadvertent arrow flight. An arrow is generally constructed having a hollow cylindrical inner diameter. A threaded insert is placed within the hollow center of the arrow shaft such that a face of the threaded insert is perpendicularly aligned to the longitudinal axis of the arrow shaft. The arrow tip is normally threaded onto or into the threaded insert and abuts the face of the threaded insert. A drawback of the conventional method of installing the threaded insert to the arrow shaft is that assembly is often done by the archer and includes an adhesive to join the threaded insert to the arrow shaft. The following situations are known to cause alignment problems: 1) the face of the threaded insert not being perpendicularly aligned to the centerline of the insert, 2) the combined misalignment of the threaded insert and arrow shaft joint, 3) the build-up of excessive amounts of adhesive between the threaded insert and the arrow shaft forcing the threaded insert face out of perpendicular alignment with the longitudinal axis of the arrow shaft. When any of these situations occur, the tip when threaded into or onto the threaded insert will abut the misaligned insert face forcing the tip out of collinear alignment with the longitudinal axis of the arrow shaft.

The adhesive used to join the threaded insert to the arrow shaft is normally an epoxy or a hot-melt glue. When applying the adhesive, an archer who is performing this operation will not have the necessary tools to ensure that the runout between the threaded insert and the arrow shaft is minimized when the threaded insert is assembled. A small error in runout (i.e., misalignment) on the mounting surface is greatly magnified at the arrow tip. The minimum magnification ratio of this error is normally about 10:1. An exemplary 0.025 mm (0.001 inch) error in runout will therefore magnify to a 0.25 mm (0.01 inch) misalignment of the arrow tip from the desired longitudinal axis of the arrow shaft.

A further drawback exists if the alignment of the machined or squared end of the arrow shaft is not perpendicular with the longitudinal axis of the arrow shaft. An archer when joining the threaded insert to the arrow shaft normally has no means of truing the end of the arrow shaft before insertion of the threaded insert. This error is further magnified when the threaded insert is joined with the arrow shaft. Most arrow shafts are now constructed of aluminum or a carbon fiber composite material. At the present time, there is a need for an effective means to machine, clean, or de-burr the end of an arrow shaft, and, when the shaft material is a carbon fiber composite, an effective means that minimizes splintering of the arrow shaft.

SUMMARY OF THE INVENTION

According to one aspect of the present invention, an apparatus is provided to perpendicularly align an end face on an arrow shaft with the arrow longitudinal axis. In this regard, the present invention may be utilized at the forward (tip) end of the arrow shaft with or without an arrow insert or the rear (nock) end of the arrow shaft. Furthermore, the present invention may be used in the first instance to assemble a new arrow during maintenance of an arrow or to re-square an arrow. The apparatus comprises a frame having at least one longitudinal channel. The channel is in parallel alignment with the frame's longitudinal axis. A cutting surface is mounted on the frame perpendicularly aligned to the frame longitudinal axis. An assembly which includes an insert and an arrow shaft is rotatably supported by the channel. The insert end of the assembly is placed adjacent to the cutting surface. The assembly is rotated within the channel and a face of the insert end is cut against the cutting surface to perpendicularly align a face of the insert end with the arrow longitudinal axis.

In a further aspect of the present invention, a hand tool for machining true an arrow insert is provided. This hand tool comprises a tool frame having a head portion and a base portion. The first channel is provided in the head portion. A second channel is provided in the base portion, wherein the second channel is collinearly aligned with the first channel. A cutting tool is supported from the head portion by a tool support channel. A cutting face of the cutting tool is perpendicularly aligned with both the channels. An arrow shaft which has an insert end is longitudinally aligned within both the channels and the insert end is rotated against the cutting face to perpendicularly true the insert end to the arrow shaft.

In a further aspect of the invention, a hand tool for machining true an arrow insert is provided. The hand tool comprises a tool frame having a head portion, a base portion, and a longitudinal axis. A V-shaped first channel is provided in the head portion. The first channel is parallel to the longitudinal axis. A V-shaped second channel is provided in the base portion. The second channel is also parallel to the longitudinal axis and collinearly aligned with the first channel. A cutting tool is supported from the head portion, the cutting tool adjacent to the first channel. A cutting face of the cutting tool is perpendicularly aligned with both the first and the second channels. An arrow shaft having an insert is longitudinally rotatably aligned along an arrow shaft longitudinal axis within both the first and the second channels. The insert is positioned adjacent to the cutting face, and the insert is perpendicularly trued by the cutting face to the arrow shaft longitudinal axis by rotating the arrow shaft within the first and second channels.

In still a further version of the invention, a method for truing an arrow insert is provided. The method comprises the steps of providing a tool frame having a head portion, a base portion, and a longitudinal axis; disposing a V-shaped first channel in the head portion, the first channel parallel to the longitudinal axis; disposing a V-shaped second channel in the base portion, the second channel parallel to the longitudinal axis; supporting a cutting tool from the head portion, the cutting tool adjacent to the first channel; perpendicularly aligning a cutting face of the cutting tool with both the first and second channel; rotatably aligning an arrow shaft within both the first and second channels; positioning the insert end of the arrow shaft and insert assembly adjacent to the cutting face; and rotating the arrow shaft within the first and second channels to remove material from a face of the insert and perpendicularly true the insert face to the arrow shaft longitudinal axis.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1A:
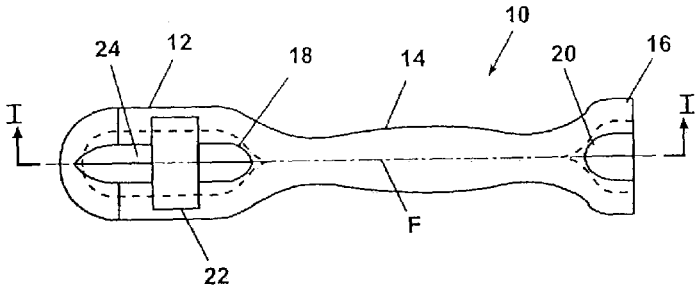
FIG. 1A is a plan view of the tool frame of the present invention.
Figure 3A:
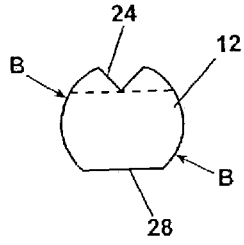
FIG. 3A is an end elevation view of the tool frame of the present invention shown in FIG. 1A.

Referring to FIGS. 1A and 3A, a tool frame 10 of the present invention is shown. Tool frame 10 comprises a head 12, a body 14 and a base 16. A first V-channel 18 is formed in the head 12. A second V-channel 20 is formed in the base portion of the tool frame 10. Both first V-channel 18 and second V-channel 20 are parallel to a longitudinal axis F of tool frame 10. A tool clearance channel 22 is formed perpendicular to the alignment of first V-channel 18. A tool support channel 24 is formed as an extended portion of the first V-channel 18.

Figure 1B:
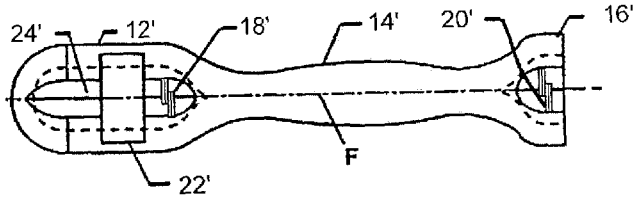
FIG. 1B is a plan view of an alternate embodiment of the tool frame.
Figure 2:
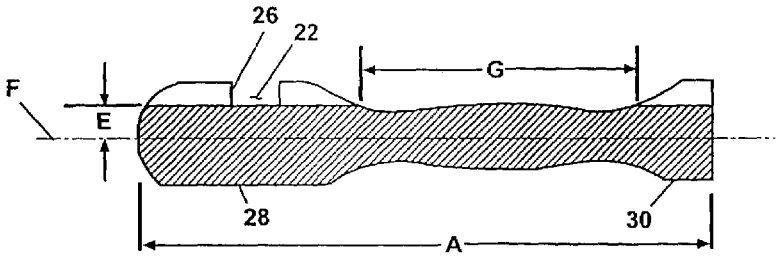
FIG. 2 is a sectioned side elevation view of the tool frame of the present invention taken through Section 2—2 of FIG. 1.

First V-channel 18, second V-channel 20 and tool support channel 24 are shown in the arrangement of FIGS. 1–3 as V-shaped channels. This configuration can be modified to suit the arrangement of the arrow design which will be supported by these channels. Other options for the arrangement of the channels include, but are not limited to, U-shaped, rounded or other concave geometric shapes, in place of first V-channel 18 and second V-channel 20 to provide means for longitudinally supporting and aligning an arrow shaft (shown in FIG. 6).

Figure 3B:
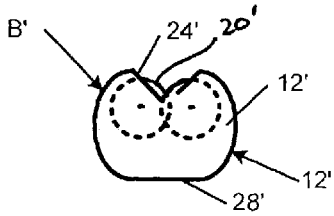
FIG. 3B is an end elevation view of the alternate embodiment of the tool frame shown in FIG. 1B.

Referring now to FIGS. 1B and 3B, an alternate embodiment of a tool frame 10' of the present invention is shown. Tool frame 10' comprises a head 12', a body 14' and a base 16'. In this alternate embodiment, a dynamic locator is utilized in place of the first and second V-channels to provide means for longitudinally supporting and aligning an arrow shaft. Specifically, the dynamic locator includes a first roller mechanism 18' formed in head 12' and a second knife edge roller 20' formed in the base portion 16' of the tool frame 10'. In this regard, the knife edge rollers include a pair of disks which are supported on the tool frame 10' so as to define a cradle for supporting the arrow shaft. Each of the disks are journally supported within the frame to allow for rotation therein. As such, the knife edge rollers function in a manner similar to the first and second V-channels 16, 18. Other dynamic locators such as ball or roller bearing mechanisms may be utilized in a similar matter, and thus are contemplated by the present invention.

Referring now to FIG. 2, a side elevation view of the tool frame 10 is shown. Tool clearance channel 22 is shown having a tool stop end 26. Flattened support faces comprising head support face 28 and base support face 30 are shown. Head support face 28 is formed at the head 12 end of tool frame 10. Base support face 30 is formed at the base 14 end of tool frame 10. Both head support face 28 and base support face 30 are co-planer and are formed such that the tool frame 10 may be supported by a flat surface to provide non-rotational support for tool frame 10. In a preferred embodiment of the invention, both the head support face 28 and the base support face 30 are provided with a non-slip surface material minimizing the potential for movement of the tool frame when put to its intended use. Head support face 28 and base support face 30 are generally formed at about a 180° rotated position from the V-shaped channel locations of the tool frame 10. This arrangement provides access to the V-shaped channels 18, 20 and the tool support channel 24 for use of the tool. FIG. 2 also shows a length A of tool frame 10. In a preferred embodiment of the invention, length A is about 15.2 cm (6 inches).

Referring now to FIG. 3, an end elevation view of tool frame 10 of the present invention is shown for the head 12 end. Head 12 comprises a diameter B. In a preferred embodiment of the invention diameter B is about 3.2 cm (1.25 inches). Tool support channel 24 comprising a V-shape is also shown. Head support face 28 is also shown in FIG. 3.

Figure 4:
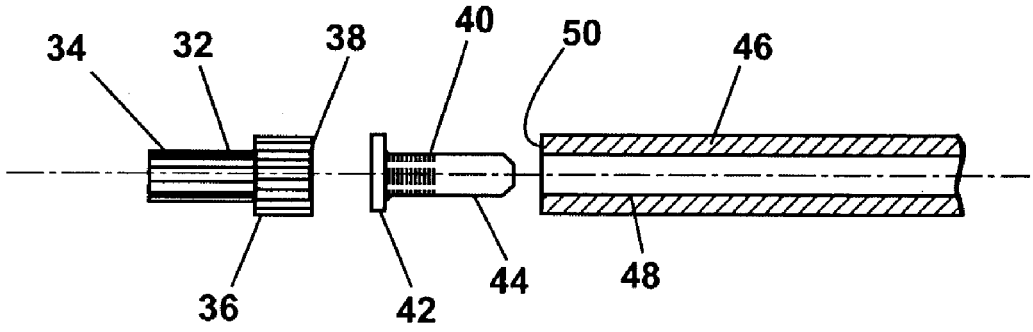
FIG. 4 is a partial cross sectional view showing the cutting face of the cutting tool and the face of the insert perpendicularly aligned with the longitudinal axis of both the insert and arrow shaft.
Figure 5:
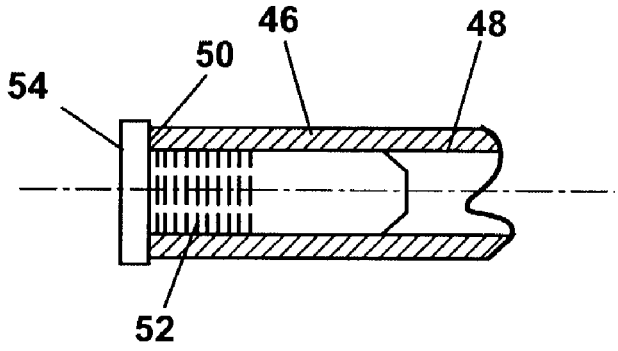
FIG. 5 is a partial cross sectional view of the insert and arrow shaft following insertion of the insert into the body bore of the arrow shaft.

Referring now to FIGS. 4 and 5, a partial cross-sectional view of a normal assembly of an insert to an arrow body in relation to a cutting tool of the present invention is shown. FIG. 4 shows a cutting tool 32, comprising a tool body 34 and a cutting head 36. A cutting face 38 of the cutting head 36 is provided such that cutting face 38 is perpendicular to a central longitudinal axis formed by the group including the cutting tool 32, the insert 40 and the arrow shaft 46. The insert 40 comprises an insert flange 42 and an insert body 44. Insert body 44 is slidably disposed into an arrow shaft 46 within an inner bore 48 of the arrow shaft 46 in a conventional manner. Arrow shaft 46 also includes an end face 50 which abuts the insert flange 42 when the insert 40 is disposed within the arrow shaft 46.

FIG. 5 shows the after-installed sub-assembly of insert 40 and the arrow shaft 46. After assembly, the insert body 44 is slidably disposed within inner bore 48 of arrow shaft 46 as shown. The insert flange 42 abuts the end face 50 of the arrow shaft 46. A plurality of retention grooves 52 are provided on insert body 44 to retain insert 40 within inner bore 48. The gap between the retention grooves 52 and the inner bore 48 is normally filled with an adhesive (not shown) to form a positive seal between the insert body 44 and the inner bore 48. The use of the adhesive often causes a misalignment, i.e., runout of the longitudinal axis of the insert 40 with respect to the longitudinal axis of the arrow shaft 46.

Arrow shaft 46 normally comprises aluminum or carbon fiber composite materials. Most modern arrow shafts are provided in aluminum material. End face 50 of arrow shaft 46 is normally provided perpendicular to the longitudinal axis of arrow shaft 46 such that an insert face 54 of the insert 40 inserted into the arrow shaft 46 is perpendicular to the longitudinal axis of the arrow shaft 46.

Figure 6:
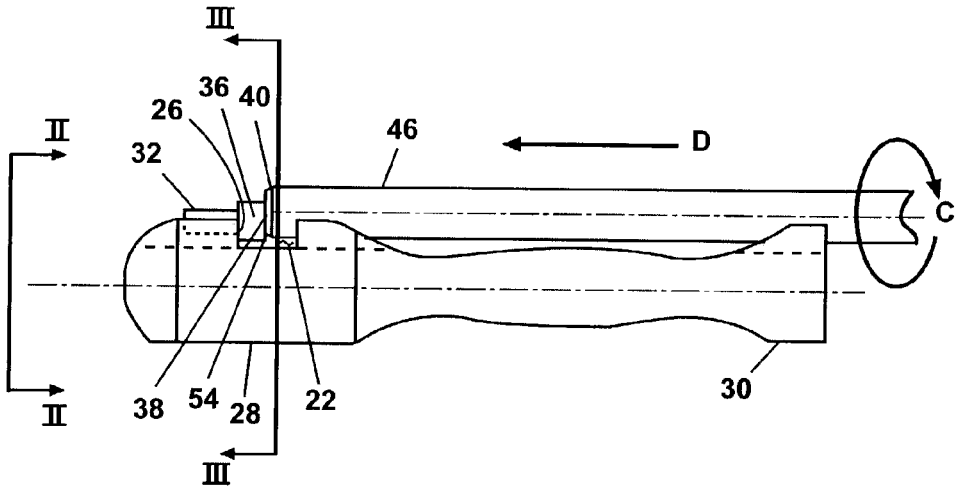
FIG. 6 is a perspective view of the tool frame of the present invention showing the installation of the cutting tool and the orientation of a typical arrow for truing the end of the arrow insert applying the present invention.
Figure 7:
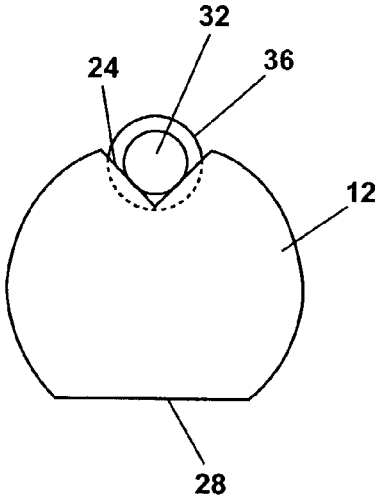
FIG. 7 is an elevation view showing the cutting tool of the present invention inserted in the support channel of the tool frame.

Referring now to FIGS. 6 and 7, the tool frame 10 having cutting tool 32 in its installed position is shown with an assembly comprising the insert 40 and arrow shaft 46 in preparation for truing the insert face 54 of the insert 40. The cutting head 36 of cutting tool 32 is arranged such that the cutting head 36 abuts the tool stop 26. The tool body 34 is supported within the tool support channel 24 of the tool frame 10 so that the cutting tool may be fixedly secured to the tool frame 10 with a fastener (not shown) or suitable adhesive. The tool clearance channel 22 is dimensioned such that the diameter of the cutting head 36 of the cutting tool 32 is provided with clearance to maintain parallel alignment between the cutting tool 32 and the longitudinal axis of the tool frame 10. When supported by the tool frame 10, the cutting face 38 of the cutting tool 32 is aligned perpendicular to the longitudinal axis of tool frame 10. An arrow shaft 46 having the insert 40 previously installed is shown in position to cut the insert face 54 of insert 40 perpendicular to the longitudinal axis of both the arrow shaft 46 and the longitudinal axis F of tool frame 10. Tool frame 10 is supported on any flat surface (not shown) by head support face 28 and base support face 30. The arrow shaft 46 is rotatably supported within both first V-channel 18 and second V-channel 20 of the tool frame 10 such that the longitudinal axis of the arrow shaft 46 is parallel to the longitudinal axis F of tool frame 10.

To cut or true the insert face 54 of the insert 40, the arrow shaft 46 is rotated in direction of arrow C as shown and simultaneously translated in direction D. A combination of rotation and translation of the arrow shaft 46 presses the insert face against the cutting face 38 to cut or true the insert face 54. It is necessary that a minimum of 50% of the surface area of insert face 54 contact the cutting face 38 of cutting tool 32. This ensures that perpendicularity of the insert face is maintained when the insert face 54 is trued.

Referring now to FIG. 7, an end view of the tool frame 10 is shown. FIG. 7 shows the head 12 and the head support face 28. The cutting tool 32 is shown supported within the first V-channel 18 along the tool support channel 24. A portion (in dashed lines) of the cutting head 36 of the cutting tool 32 abuts the tool stop 26 to retain the cutting tool 32 against the translation of the arrow shaft 46 in the direction D shown in FIG. 6.

Figure 8:
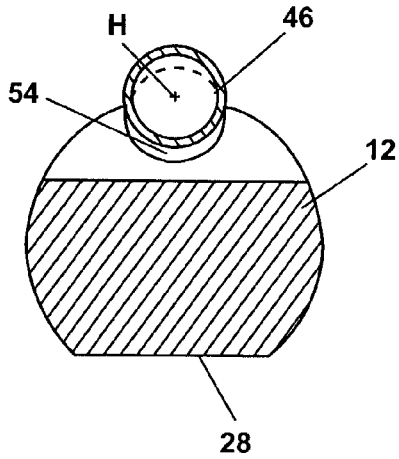
FIG. 8 is a cross section view taken along section III—III of FIG. 6 showing greater than 50% contact between the arrow insert face and the cutting tool face of the present invention.

Referring to FIG. 8, a section view is shown through the end of arrow shaft 46 looking toward the cutting face 38 of the cutting tool 32. It is important to maintain a minimum of 50% engagement between insert face 54 of insert 40 and the cutting face 38 of cutting tool 32. As shown in FIG. 8, this is accomplished by having the arrow longitudinal axis H positioned below the top of the cutting face 38. A 360° rotation of arrow shaft 46 will therefore allow the entire surface of insert face 54 to contact cutting face 38.

Referring back to FIG. 2, the vertices of first V-channel 18 and second V-channel 20 lie in the plane E defined by tool support channel 24. It is critical that this relationship be maintained in order to retain the collinear alignment of these channels in parallel with the longitudinal axis F of the tool frame 10. Dimension A, the length of tool frame 10, and dimension G, the distance between first V-shaped channel 18 and second V-shaped channel 20, are controlled such that an arrow shaft 46 supported between the V-shaped channels will not be separated by too great a distance allowing the arrow shaft to skew or bend between V-shaped channel support points. Dimension G is also controlled to maintain sufficient clearance between V-shaped channels to prevent an arrow shaft from 'rocking-out' of V-shaped channel 18 due to insufficient support length, and subsequent non-perpendicular cutting of the insert 40. It is also necessary to size and position the V-shaped channels to maintain clearance between the diameter of the body 14 and the arrow shaft. This clearance ensures that an arrow shaft 46 supported by the tool frame 10 will not contact the body 14 as the arrow shaft 46 rotates.

Cutting tool 32 can be affixed to tool frame 10 in a permanent or semi-permanent installation. Means (not shown) of attaching cutting tool 32 to tool frame 10 can be by a strap (not shown) or other mechanical devices. It is necessary to retain the cutting tool 32 against the tool support channel 24 such that the cutting tool 32 is not allowed to rotate as the arrow shaft 46 rotates against the cutting face 38 of the cutting tool 32. A semi-permanent means of affixing the cutting tool 32 is preferred as it permits replacement of the cutting tool 32. The end face 50 of the arrow shaft 46 may also be trued, de-burred, or cleaned using the cutting tool 32 of the present invention. If the arrow shaft 46 material is aluminum, the invention can readily be used to true the end of the arrow shaft 46. If the arrow shaft 46 is a carbon fiber composite material, however, the material of the arrow shaft may splinter against the cutting face 38 of cutting tool 32. The truing of the face of an arrow shaft of carbon fiber composite material must therefore be performed with greater care. When truing, de-burring, or cleaning the end face 50 of an arrow shaft of carbon fiber composite material, the preferable material for the cutting face 38 of the cutting tool 32 would be an abrasive such as a diamond impregnated adhesive, aluminum oxide or carborundum in place of carbide.

In one version of the invention the V-shaped channels 18 and 20, as well as the tool support channel 24 are anodized with a hard plastic coating impregnated in the face of each V-channel. Providing this anodized face reduces the friction when the arrow shaft rotates within the V-shaped channels. In another version of the invention, the V-shaped channels are not anodized with a plastic coating because the material of tool frame 10 comprises a metallic material such that the V-shaped channels are hardened to a Rockwell hardness in the range of about C60 to about C70 Rockwell hardness. This degree of hardness promotes minimum sliding friction between the V-shaped channel and the outside body of the arrow shaft. In yet another version of the invention, the use of dynamic locating devices (e.g. knife-edge rollers, ball or roller bearings, etc.), in place of V-channels, would promote minimum friction in the rotation of the arrow shaft.

Modern arrow shafts vary in diameter up to about 0.89 centimeters (0.35 inches). The use of V-shaped channels or an alternate to the V-shaped channel identified herein assures that the longitudinal axis of the arrow shaft is parallel to the longitudinal axis F of the tool frame 10 regardless of its diameter.

The preferable material for the cutting face 38 of the cutting tool 32 is a high strength steel or carbide material. Other materials can be substituted for the cutting face 38 including Carborundum, aluminum oxide, diamond impregnated, or similar abrasives in place of carbide. A smooth finish is desired for the insert face 54 after truing by the present invention. The material for tool frame 10 is preferentially aluminum. Plastic materials can also be used for tool frame 10 provided that the material chosen provides sufficient stiffness to maintain collinear alignment of the V-shaped channels (including the tool support channel). Collinear alignment of the V-shaped channels is critical to permit truing of the insert face 54 perpendicular to the longitudinal axis of the arrow shaft.

The geometry of the V-shaped channels can be varied from that shown by the figures provided herein without departing from the spirit and scope of the present invention. A V-shaped channel is preferred in order to accommodate a wide range of arrow shaft diameters with the present invention. While V-shaped channels 18, 20 and 24 as shown have an included angle of 90°, a greater or less than 90° separation between walls of the channels can be used without departing from the spirit or scope of the invention. Likewise, other geometric shapes or dynamic locating devices can also be provided as long as the requirement for a minimum of 50% engagement between insert face 54 of insert 40 and the cutting face 38 of cutting tool 32 is provided.

It is desirable to cut or true the insert face of the insert to within about 0.008 mm (0.003 inches) perpendicularity to the longitudinal axis of the arrow shaft. In use it is also desirable to identify when the insert face has been trued over its entire face. This can be accomplished by first marking the insert face, prior to engaging the insert face with the cutting tool, with a material such as a bluing agent, a chalk material, or an ink, i.e. from a permanent ink marker. Visual indication of complete cutting of the insert face will therefore be provided by removal of the marking material from the insert face by the cutting tool.

The present invention provides several advantages. A user in the field can improve the collinear alignment of an arrow tip to the longitudinal axis of the arrow shaft, thus improving arrow flight accuracy. The cutting tool is provided on a tool frame which is relatively small to be easily transported and used in the field. The cutting tool is replaceable and the overall tool frame can be supported on any flat surface.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A hand tool for machining true an arrow shaft end comprising:

a tool frame having a head and a base;

a support cradle located in said tool frame including means for rotatably supporting an arrow shaft along a support cradle axis; and a cutting tool supported in said head in front of said support cradle to provide a tool stop, said cutting tool having a cutting element perpendicularly aligned with said support cradle axis;

whereby said tool stop is adapted to abut an end of the arrow shaft such that the end engages said cutting element.

2. The hand tool of claim 1 wherein said support cradle further comprises at least one channel formed in said tool frame.

3. The hand tool of claim 2 wherein said at least one channel further comprises a first channel formed in said head and a second channel formed in said base.

4. The hand tool of claim 3 wherein said tool frame further comprises a body interconnecting said head with said base.

5. The hand tool of claim 1 wherein said support cradle comprises a v-shaped channel formed in said tool frame to support the arrow shaft.

6. The hand tool of claim 1 wherein said support cradle comprises a dynamic locating device coupled to said tool frame to support the arrow shaft.

7. The hand tool of claim 6 wherein said dynamic locating device comprises first and second rollers defining said support cradle, each of said first and second rollers having an axis of rotation parallel to said support cradle axis.

8. A hand tool for machining true an arrow shaft end, said hand tool comprising:

a frame having a channel formed therein defining a longitudinal channel axis;

a cutting tool supported in said frame in front of said channel to provide a tool stop, said cutting tool having a cutting element perpendicularly aligned with respect to said longitudinal channel axis;

wherein an arrow shaft is rotatably supported in said channel such that an end of said arrow shaft abuts said tool stop and engages said cutting element and a longitudinal arrow axis of said arrow shaft is in parallel alignment with said longitudinal channel axis, said arrow shaft rotatable relative to said cutting element to perpendicularly align said end with said arrow longitudinal axis.

9. A method for truing an arrow shaft end comprising:

providing a tool having a frame with a support cradle defining a longitudinal axis and a cutting tool located in front of said support cradle to define a tool stop and having a cutting element perpendicular to said longitudinal axis;

rotatably supporting an arrow shaft in said support cradle such that a longitudinal axis of said arrow shaft is parallel to said longitudinal axis of said support cradle and an end of said arrow shaft abuts said tool stop and engages said cutting element; and rotating said arrow shaft relative to said cutting tool to remove material from said end thereby truing said end with respect to said longitudinal axis of said arrow shaft.

10. The method of claim 9 further comprising:

marking said end with an indicia prior to rotation of the arrow shaft against the cutting element; and removing material from the end with the cutting element until said indicia is removed.

11. The hand tool of claim 1 further comprising a planar support face formed in said tool frame on a side opposite said support cradle.

12. The hand tool of claim 11 wherein said planar support face is provided with a non-slip surface.

13. The hand tool of claim 4 wherein said head and said base are maintained in a spaced-apart relation by said body.

14. The hand tool of claim 4 wherein said body further comprises a grip.

15. The hand tool of claim 1 wherein said cutting tool is selected from a group consisting of a high strength steel cutting element, a carbide cutting element, and an abrasive element.

16. The hand tool of claim 1 wherein said cutting tool comprises an abrasive element selected from the group containing a diamond impregnated adhesive element, an aluminum oxide element and a Carborundum element.

17. The hand tool of claim 8 wherein said frame further comprises a head and a base maintained in a spaced-apart relation by a body.

18. The hand tool of claim 8 wherein said frame further comprises a planar support face formed on said frame opposite said v-shaped channel.

19. The hand tool of claim 8 wherein said cutting tool is selected from a group consisting of a high strength steel cutting element, a carbide material cutting element, and an abrasive element.

20. The hand tool of claim 8 wherein said cutting tool comprises an abrasive element selected from the group consisting of a diamond impregnated adhesive element, an aluminum oxide element and a Carborundum element.

* * * * *